US006470806B1

(12) United States Patent
Murray

(10) Patent No.: US 6,470,806 B1
(45) Date of Patent: Oct. 29, 2002

(54) CARTRIDGE FORMAT DELAY IGNITER

(76) Inventor: Kenneth R. Murray, 3516 Furlong Way, Gotha, FL (US) 34734

( * ) Notice: Subject to any disclaimer, the term of this patent is extended or adjusted under 35 U.S.C. 154(b) by 0 days.

(21) Appl. No.: 09/514,258

(22) Filed: Feb. 28, 2000

(51) Int. Cl.[7] ..... F42B 8/26

(52) U.S. Cl. ..... 102/498; 102/498; 102/499; 102/370

(58) Field of Search ..... 102/498–499, 102/370, 367, 368, 482, 486, 444, 446

(56) References Cited

U.S. PATENT DOCUMENTS

| | | | | | |
|---|---|---|---|---|---|
| 1,539,609 | A | * | 5/1925 | Taylor | 102/498 |
| 1,894,203 | A | * | 1/1933 | Spring | 102/368 |
| 2,000,131 | A | * | 5/1935 | Goss | 102/368 |
| 2,115,608 | A | * | 4/1938 | Brandt | 102/498 |
| 2,562,928 | A | * | 8/1951 | Lewis | 102/368 |
| 2,646,750 | A | | 7/1953 | Diels | 102/85.6 |
| 2,800,079 | A | * | 7/1957 | Jacobs | 102/498 |
| 2,817,294 | A | * | 12/1957 | Hjellnes | 102/498 |
| 3,194,161 | A | * | 7/1965 | Becker et al. | 102/498 |
| 3,439,614 | A | * | 4/1969 | Schneppe, Jr. | 102/367 |
| 3,505,959 | A | * | 4/1970 | Lohnert et al. | 102/368 |
| 4,459,914 | A | | 7/1984 | Caruso | 102/204 |
| 4,699,063 | A | * | 10/1987 | Aschwanden et al. | 102/498 |
| 4,926,752 | A | * | 5/1990 | DiRubbio et al. | 102/486 |
| 4,932,328 | A | * | 6/1990 | Pinkney et al. | 102/368 |
| 5,069,134 | A | | 12/1991 | Pinkney | 102/368 |
| 5,074,217 | A | * | 12/1991 | Gabriels | 102/482 |
| 5,074,218 | A | * | 12/1991 | Castro | 102/498 |
| 5,085,147 | A | * | 2/1992 | Gold et al. | |
| 5,196,649 | A | * | 3/1993 | DiRubbio et al. | 102/486 |
| 5,654,523 | A | * | 8/1997 | Brunn | 102/498 |
| 5,824,945 | A | * | 10/1998 | Barlog et al. | 102/482 |

FOREIGN PATENT DOCUMENTS

| | | |
|---|---|---|
| EP | 0 196 278 A | 10/1986 |
| FR | 1127263 A | 12/1956 |
| FR | 1210707 A | 3/1960 |
| GB | 2007339 A | 5/1979 |

* cited by examiner

*Primary Examiner*—Charles T. Jordan
*Assistant Examiner*—Lulit Semunegus

(57) ABSTRACT

A training device for simulating the action of stun grenades and the like is provided by combining a delay cartridge with a conversion fitting that installs in a grenade body. A firing assembly fitted to the grenade body over the delay cartridge is percussively initiated through release of a hammer to activate a primer located on the end of the cartridge. The cartridge contains a delay-burning compound that subsequently activates a pyrotechnic charge. A suitable application is for training in the use of flash/bang training devices or "stun" grenades.

7 Claims, 7 Drawing Sheets

CARTRIDGE FORMAT DELAY IGNITER

FIELD OF THE INVENTION

This invention relates in general to the field of military and law enforcement training and more particularly to the use of simulation devices used for anti-personnel, anti-riot and anti-terrorist training. It applies where training in the use of pyrotechnic devices, such as Stun Grenades, is required to teach users how to properly deploy the actual devices. The described invention is also intended to permit training within areas and structures which might normally preclude the use of the actual devices or other existing training devices.

BACKGROUND TO THE INVENTION

Military and law enforcement personnel are often required to deploy explosive or otherwise pyrotechnic devices during the performance of their duty. Such devices typically must be handled with great care and are expensive to use due to their destructive nature. They are restricted to being deployed only under tightly controlled conditions. This applies when such devices are used operationally, as well as in specialized training structures and remote locations during training.

Simulation training has been gaining in popularity over the past several years and devices that permit extremely realistic training for armed encounters have been introduced. For SWAT Team training and Counter-Terrorism or Anti-Riot training, police and military forces must be able to train as realistically as possible for personal safety as well as the safety of the general public. During actual encounters, these officers and soldiers will deploy pyrotechnic devices such as Stun Grenades, also known as Distraction Devices or Flash-Bangs. Examples of such grenades can be referenced in U.S. Pat. No. to Gold (U.S. Pat. No. 5,085,147), Barlog (U.S. Pat. No. 5,824,945), Hamilton (U.S. Pat. No. 4,976,201), Nixon III (U.S. Pat. No. 4,947,753), Pinkney (U.S. Pat. No. 4,932,328) and Brunn (U.S. Pat. No. 5,654,523).

To date, products which have been introduced as pyrotechnic training devices designed to replicate actual devices have been costly, dangerous and limited in their ability to be transported in a cost-effective fashion. Further, these training devices have been limited to possession by bona fide police and military agencies or civilian training institutions that must pay for expensive licensing to obtain access to these devices.

The described invention is not intended for actual use in combat settings nor designed for use as a weapon, but rather is specifically designed and contemplated as a training device to be used during simulations and for training in the use of the Stun Grenades and the like, including smoke and gas grenades.

It would therefore be desirable to have a training device that would permit safe and realistic training that fully replicates the operational features of the actual pyrotechnic device. Identical or close to identical size, weight, shape, function, and feel of the training device would permit trainees to experience all of the aspects to habituate them to the deployment of the actual device. It would be desirable that the training device would be rechargeable with inexpensive reloads that are not as restrictive for transportation and possession purposes as are currently available operational or training devices. This invention addresses those objectives.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

With the foregoing in mind, it is a principal object of this invention to provide a blank training cartridge that incorporates a delay feature that permits safe and easy reloading of a Training Device so that it can be reused a number of times, thus making it cost effective for training purposes. This part of the invention shall hereafter be called a "Delay Cartridge". When the Delay Cartridge is loaded within a pyrotechnic body designed to make noise to simulate an explosion, the cartridge will be referred to as a "Delay Blank". These may also be interchangeably referred to as "Reloads".

According to one aspect of the invention a delay-blank cartridge is provided having a casing, a percussion-sensitive primer mounted at one end, the primer communicating through an internal passageway within the case (preferably provided by a sleeve) with a "low gas", delay-burning composition contained within the case. Optionally, to ensure that the primer is able to ignite the delay-burning composition, an ignition composition may be placed between these two components of the invention on the side of the delay-burning composition opposite the primer and the first igniter. A second igniter may optionally be positioned to be initiated by the delay-burning composition once combustion has passed through the thickness of this composition.

The second igniter may then be positioned to communicate with the pyrotechnic material that is to be activated. In the application of a training grenade, this may simply be a non-percussion sensitive flash powder, a gas generant or other composition that is contained either in the casing of the cartridge itself, or extending outside the casing.

By use of the Delay Cartridge a method of ignition or dispersion of minuscule amounts of pyrotechnic substances may also be provided that will allow simulation of devices such as smoke grenades and chemical irritant grenades. This will provide trainees with feedback in the form of a visual signature for verification of delivery or wind drift considerations without the inherent visual or environmental contamination associated with operational devices.

These and other objects of the present invention may be achieved by combining the Delay Cartridge with a Training Device that includes a Conversion Fitting fitted into a case or body to adapt the body to receive a Reload. To this is added a Firing Assembly that will fire the Reload. Preferably the body of the Training Device replicates the exterior form of actual devices such as Stun Grenades, Smoke Grenades, Anti-Personnel Fragmentation Grenades, Mines and Booby Traps that would be used in an operational setting. The Conversion Fitting has a chamber that is shaped to receive the Reload and is engaged, e.g. threadably received, into the body of the Training Device. Using special adapters, a Conversion Fitting may also permit users in some cases to utilize the body of their normal operational device as a Training Device, having first rendered it permanently or temporarily incapable of accepting dangerous pyrotechnics through the installation of such a Conversion Fitting.

Because the invention contemplates using commercially available brass cartridge cases that are normally used in firearms, the finished cartridge may be formed in such a manner, and a Conversion Fitting chamber designed in such a way, that it would readily accept only a Reload, excluding by design similar live cartridges that are designed for use in firearms.

The Firing Assembly will provide further safety to users in that it can be manually armed and locked prior to attachment to the Training Device, after the insertion of the Reload into the Conversion Fitting, thereby protecting the Reload from being inadvertently activated prior to the Training Device being deployed in training. For further security the Reloads may be stored separately from the unarmed Training Device under high security arrangements.

To the accomplishment of the foregoing and related ends, the invention, then, comprises the features hereinafter fully described and particularly pointed out in the claims, the following description and the annexed drawings following hereafter. This sets forth in detail certain illustrative embodiments of the invention. These are indicative, however, of but several of the various ways in which the principles of the invention may be employed.

DESCRIPTION OF THE PREFERRED EMBODIMENT

Figure 1:
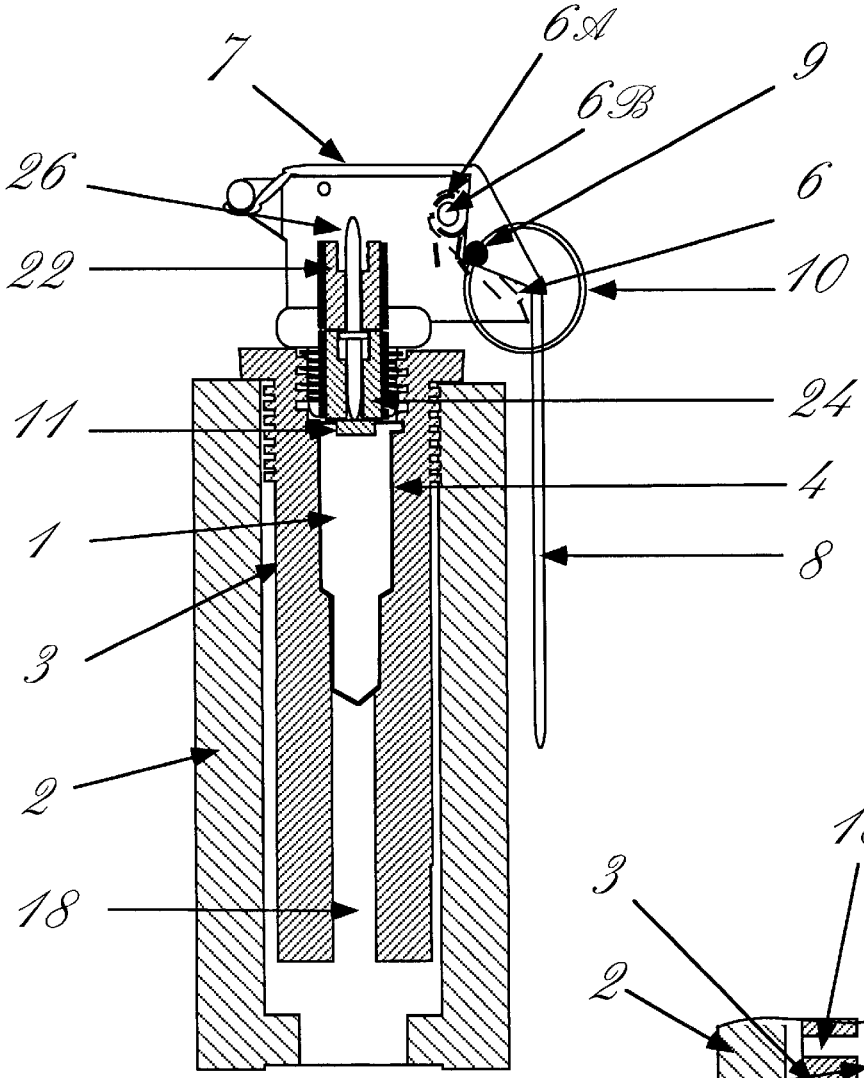
FIG. 1 is a cross-section of a flash/bang diversionary device showing the Delay Cartridge of the invention installed therein.

In FIG. 1 a Training Device is provided by a Delay Cartridge 1 installed in a practice grenade case or body 2 by insertion into a Conversion Fitting or cartridge containment unit 3 that is attached, as by being screwed, into the grenade body 2. The Conversion Fitting 3 has a chamber 4 shaped to receive the cartridge 1 and a ventilation port 18 to allow escape of gases of combustion. The length of the chamber 4 is limited by the absence of sufficient length to receive a cartridge that includes a protruding projectile. Thus, only a Reload 1 will fit into the chamber 4.

The primer 11 may be struck directly or, as shown, the Training Device may be provided with a firing pin 26 which moves downwardly inside channels through set screws 22,24 contained in a threaded tube 23 fitted into head 5, striking the primer 11 when struck by the hammer 6.

Figure 4:
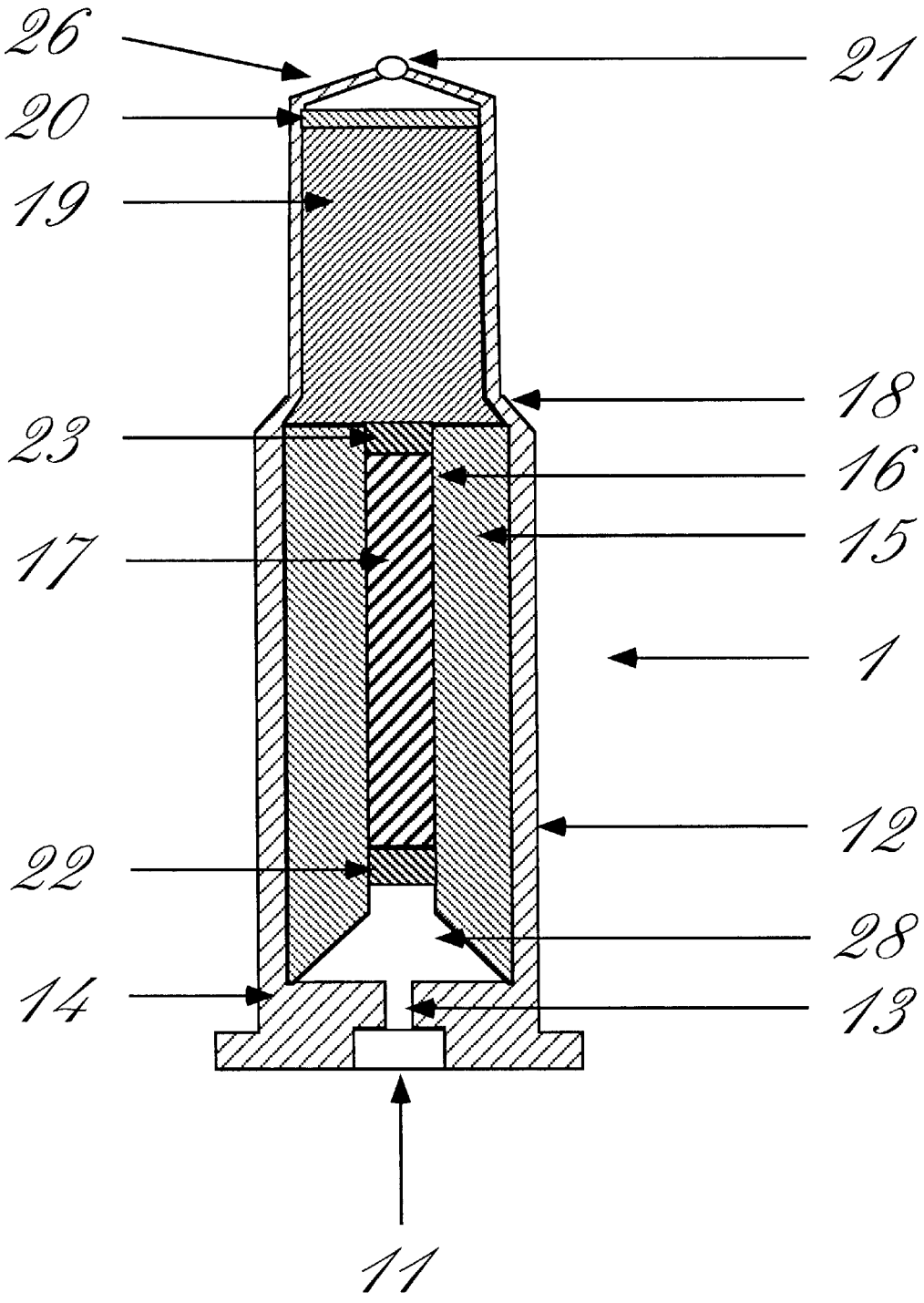
FIG. 4 is a cross-sectional view of the Delay Cartridge of the invention.
Figure 5:
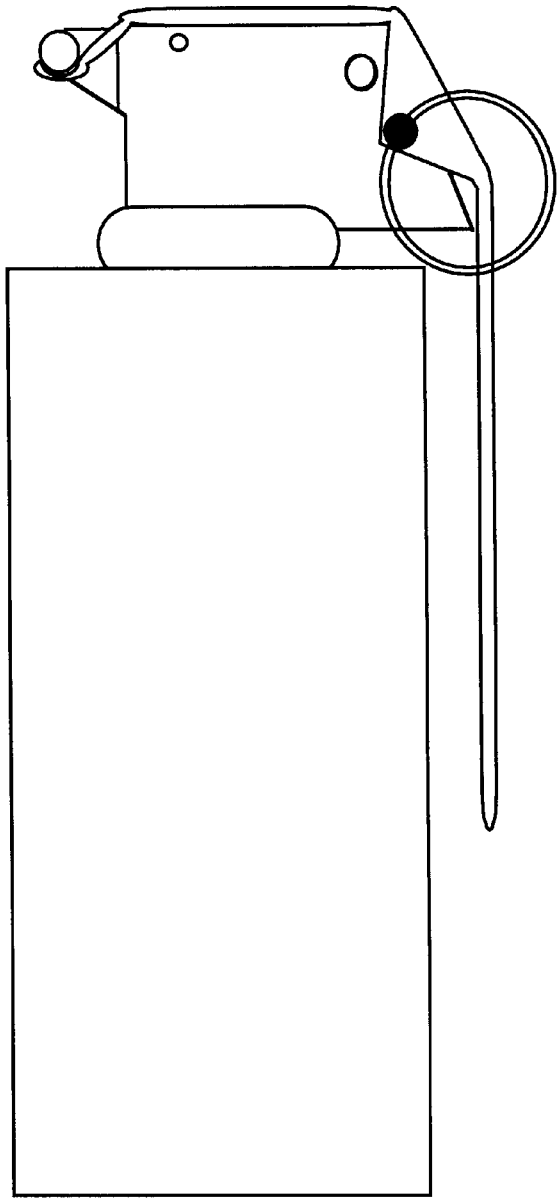
FIG. 5 is an exterior side view of a device as in FIG. 1 showing the external appearance of one format of training device, as fully assembled.

In FIG. 4 a delay cartridge 1 is shown in cross-section wherein the casing flash channel 13 extends through the cap end 14 of the casing 12 from the primer 11 to the interior of the cartridge 1. A sleeve insert 15 within the casing 12, optionally of aluminum, has a hollow tubular core passageway 16 that is partially packed with a delay-burn combustion composition 17, or "delay composition" 17. The entrance 28 to the core 16 may be optionally bevelled.

The casing 12 may be swagged inwardly at a neck 18 at the end of the sleeve 15 containing it tightly in place. This also narrows the forward end of the casing 12 giving it a non-standard shape. This serves to preclude the insertion of regular cartridges into the chamber 4 as such chamber 4 is of a complementary shape to the cartridge 1.

Forward of the neck 18 in the casing 12, the casing 12 is fitted with a flash powder mixture 19 (if the application is for a stun grenade). Other pyrotechnic substances, such as smoke or gas generants may be used in place of the flash powder mixture 19. A disk 20 of, for example, polyethylene sheeting, tops-off and contains the powder mixture and is retained in place by crimping 26 provided by the front edges of the casing 12. A sealant 21 in the form of wax, lacquer, glue, or the like may also optionally be placed over the crimping 26 to exclude moisture and/or retain the compounds within the case.

This sealant 21 should preferably be dislodgeable and cover an aperture whereby gases from the flash compound 17 may readily escape from the cartridge 1 and, in the case of a stun grenade, provide noise and/or a small flash. In applications where the cartridge 1 serves as an igniter for further pyrotechnic compounds either a jet of igniting gases may be emitted through the aperture closed by the sealant; or, if an explosive charge is contained in the front end of the casing 12 the crimping 26 may open-up to release the explosive gases.

Figure 1A:
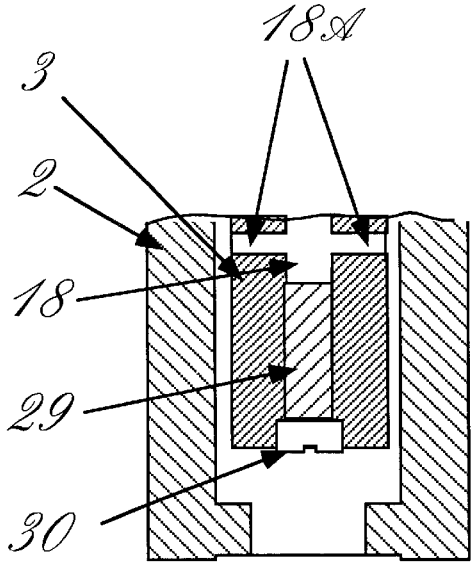
FIG. 1A is a partial cross-section of a variant on FIG. 1 containing a smoke pellet to be ignited by the Delay Cartridge.
Figure 2:
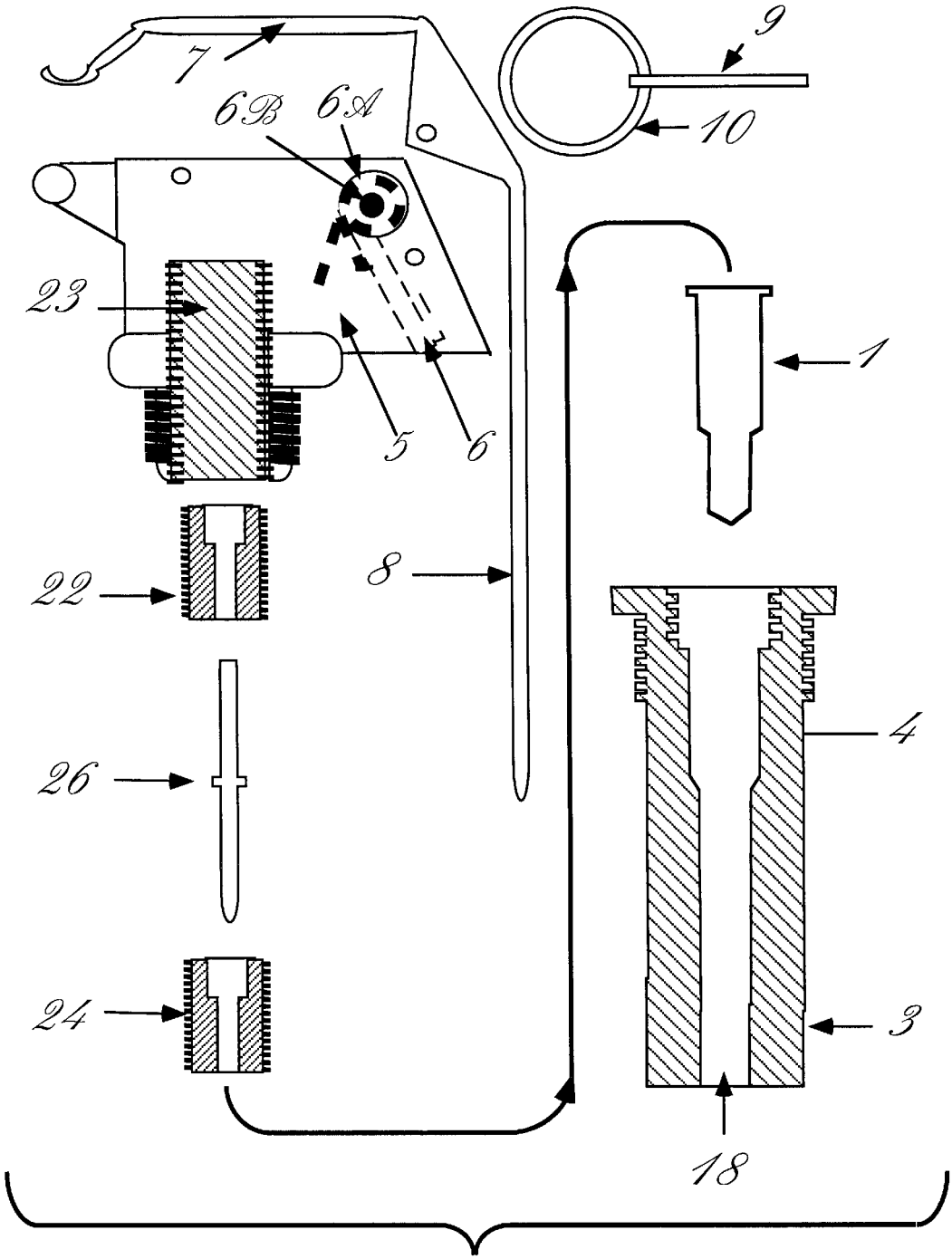
FIG. 2 is an exploded view of the components of the device of FIG. 1, other than the outer body or case.
Figure 3:
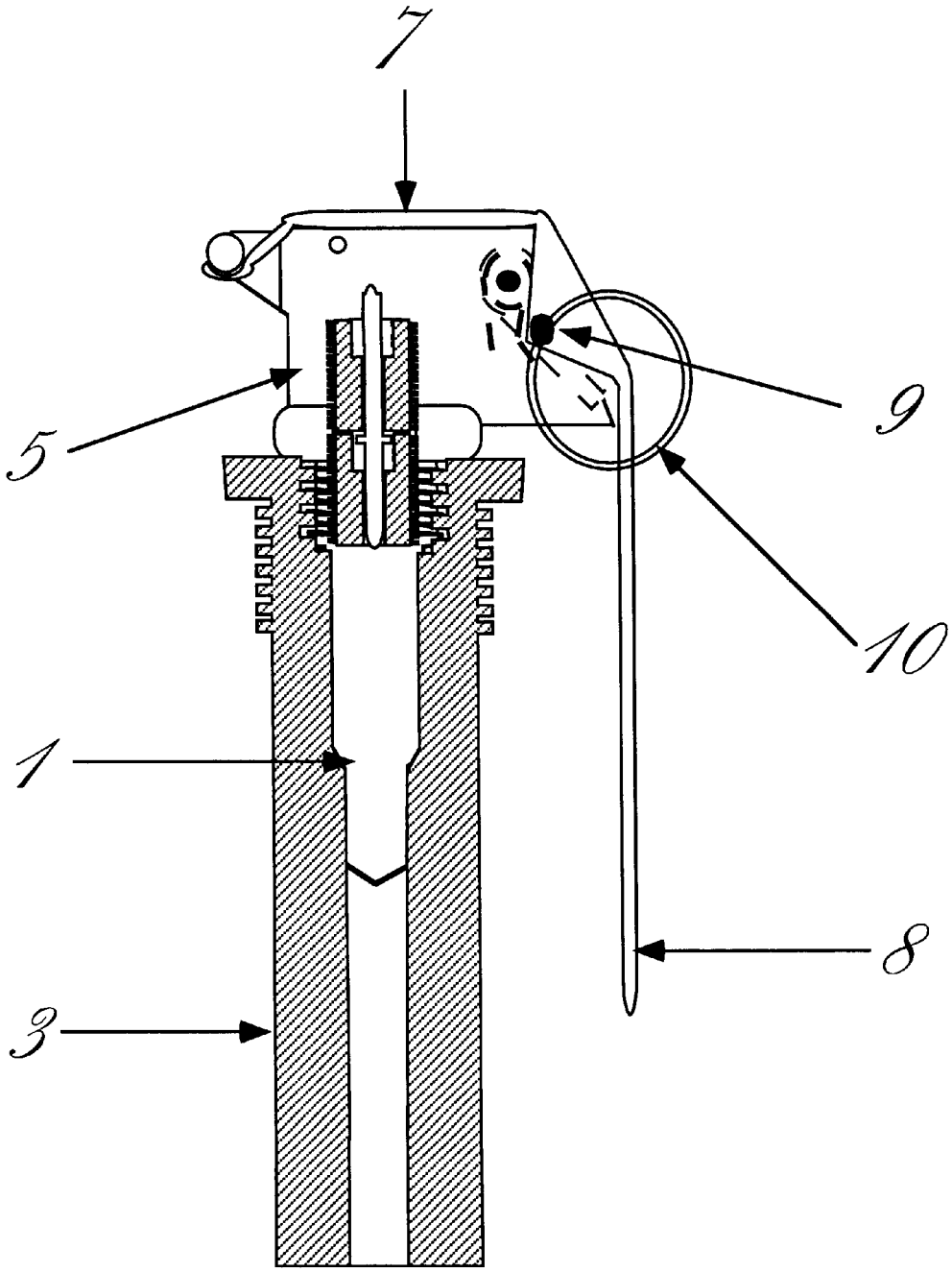
FIG. 3 is a cross-sectional view of the components of FIG. 2 assembled for insertion into the body of a training device.
Figure 6:
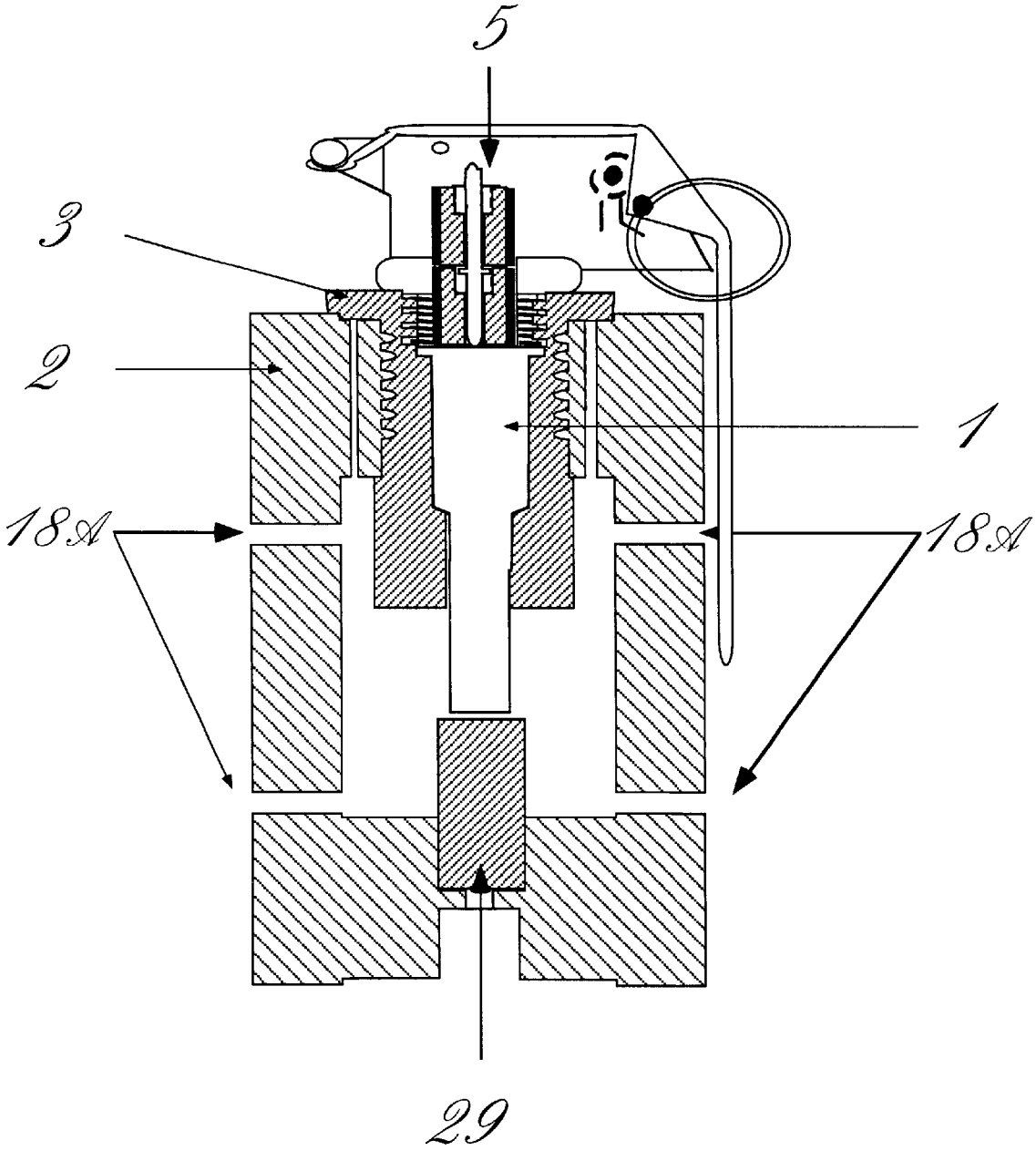
FIG. 6 is a cross-sectional view of a training device having a differing form of body with ports for releasing smoke generated within the device.

Pyrotechnic substances, such as a smoke pellet 29 may be placed in the path of escaping, igniting gas. In this variant, as shown in FIG. 1A, a threaded plug 30 may close-off the port 18 containing the pellet 29 in place, allowing that alternate ports 18A are provided to allow for the escape of gas and smoke. This cartridge 1, in such applications, need not contain a separate pyrotechnic composition 19. A delay composition 17 may be employed which will be capable of igniting a smoke pellet 29 if the sealant 21 is, itself, consumable or otherwise does not interfere with ignition. Alternately, no crimping 26 may be incorporated into the cartridge 1 to ensure that flame from the delay composition 17 ignites the smoke pellet 19. An arrangement based on this configuration is depicted in FIG. 6.

For the primer 11, various known commercially available cartridge primers may be employed. For the delay-burn compound 17, any of the common low-gas delay compositions have been found acceptable including MIL-T-12132 tungsten compound, MIL-D-85866 zirconium-nickel compound, MILD-85360A boron-potassium nitrate compound as specified by the United States Department of Defence, as examples. These compounds 17 may be blended to provide, for example, a 1 ½-2 second delay while burning a length of 18–20 mm within the core 16 which itself has a diameter of 4.75 mm. When blended appropriately, these compounds 17 will ignite directly from a standard cartridge primer 11 without the need for igniter layers. Further, these compounds generate little gas, i.e. are "gasless", and thereby avoids gas pressure build-up that might otherwise dislodge the delay-burning composition from the core 16 of the sleeve 15, or alternately dislodge the sleeve 15 from the casing 12.

In the instance of delay compositions 17 that do not readily ignite directly, an igniter compound 22 may be contained within the core 16 at the primer end of the delay composition 17. Similarly, to facilitate ignition of various compounds in the space occupied by the flash powder 19, a second igniter 23 layer of similar function may be placed at the exit end of the delay composition 17.

The casing 12 may be made of brass or other suitable metal or injection molded, polymeric plastic material. The sleeve insert 15 is preferably made of aluminum although suitable molded plastic material may also be employed. The tamping disk 20 may be wax or a polymeric plug, which serves as a vapour barrier.

By selecting the length of delay composition 17 present in the core 16, as well as the blending of composition 17, various time delays may be produced.

The use of a sleeve 15 with a core 16 to contain the delay-composition 17 is particularly convenient. The delay-composition 17 may be separately tamped in place in the core 16 prior to insertion in the case 12. Because such a compositions 17 are percussion and pressure insensitive, handling procedures are less stringent than would arise if the delay-composition were to be pressed into a cartridge 1 with a primer 11 present. Thus, the method of assembling the delay cartridge 1 entails separate insertion of the delay composition 17 into the core 16 of a sleeve 15 followed by assembly of the sleeve 15, so filled, into the casing 12.

To ensure that the delay composition 17 is not "blown through" the core by such gases as are generated within the casing 12, it is preferable that the core passageway 16 have a width that is much less than its length, e.g. an aspect ratio of 1:4 or more. As well, the interior surface of the core 16 may be scored or threaded to increase frictional coupling between the delay-composition 17 compacted therein and the walls of the core 16.

Training Devices made in accordance with the invention a re inherently of a safer design. Because the percussion-sensitive primer 11 is contained within the end of a cartridge case 12, it is protected from casual detonation. Because the cartridge 1 may contain only a small amount of explosive compound, it is relatively safe compared to larger quantities of explosives.

Figure 7:
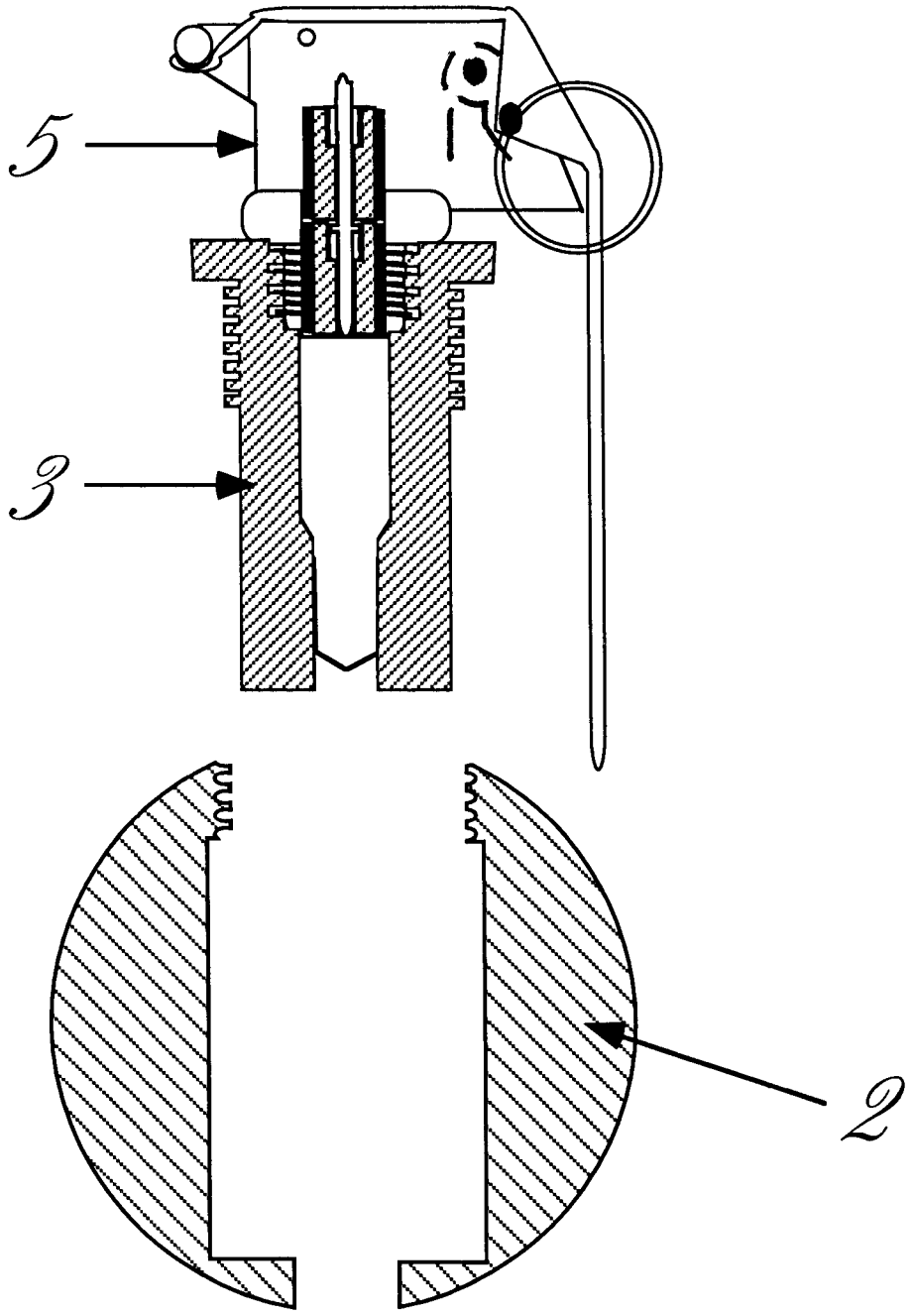
FIG. 7 is an exploded assembly cross-sectional drawing of a Conversion Assembly for insertion into the body of a training format fragmentation grenade.

In the case of flash/sound training grenades, as well as other applications such as the simulating smoke and fragmentation grenades of FIGS. 6 and 7, cartridge 1 may be inserted in the Conversion Fitting chamber 4 and the Firing Assembly may be installed at the last minute before use from a controlled storage system. The grenade body 2 in such situations is totally inert and requires no special handling or storage. If such body 2 and the Conversion Fitting 3 are sufficiently robust, they may be reused indefinitely.

Accordingly, an inexpensive igniter for pyrotechnics and explosives has been described that will provide a useful alternative to existing systems.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A noise-making training device comprising:

(1) a body for containing a delay cartridge to produce a pyrotechnic demonstration;

(2) a conversion fitting mounted on said body, said conversion fitting being provided with a chamber for slideably receiving and removeably containing said delay cartridge;

(3) a delay-cartridge contained within said chamber, said cartridge comprising:

(a) a casing with a cap end;

(b) a percussion-sensitive primer mounted at the cap end of the casing;

(c) an internal passageway within the casing containing a delay-burning composition and communicating with the primer; and (d) a pyrotechnic composition contained within the casing at the end of the internal passageway remote from the primer and positioned to be ignited by the delay burning composition and release pyrotechnic gases, and (4) a firing assembly including a releaseable hammer actuated by a spring means carried on said conversion fitting for actuating the primer of the cartridge for firing;

said firing assembly being removeably connected to said conversion fitting to permit:

(i) insertion of said cartridge into said chamber prior to the firing of said cartridge, (ii) containment of said cartridge during firing, and (iii) extraction of the spent delay cartridge by removal of the firing assembly from the conversion fitting after firing, thereby permitting reuse of the training device by insertion of a fresh delay cartridge into the chamber within the conversion fitting with the firing assembly removed, and re-connection of the firing assembly to the conversion fitting thereafter to reminder the training device ready for use.

2. A training device as in claim 1 wherein said firing assembly comprises a sliding firing pin with said hammer positioned to strike the firing pin under urging by said spring means when released to actuate said primer.

3. A training device as in claim 1 wherein said firing assembly comprises a spoon with a handle mounted to the firing assembly to retain the hammer in a cocked condition before release of the handle, and a safety pin attached to a pull ring and fitted through a portion of said firing assembly to restrain the spoon and handle from releasing the hammer prior to the removal of the safety pin from the firing assembly, wherein, upon removal of the safety pin and release of the spoon, the hammer will swing to actuate the primer and fire the cartridge and whereby the firing assembly may be assembled to contain the cocked hammer separately from the presence of the delay cartridge permitting subsequent mounting of the firing assembly onto the conversion device with the delay cartridge in place within the chamber of the conversion device.

4. A training device as in claim 1 wherein said firing assembly is positioned to bear against the cap end of the delay-cartridge on assembly onto the conversion device to effect containment of said cartridge and primer in position within said chamber during firing.

5. A training device as in claim 2 wherein said firing assembly is positioned to bear against the cap end of the delay-cartridge on assembly onto the conversion device to effect containment of said cartridge and primer in position within said chamber during firing.

6. A training device as in claim 2 wherein said firing assembly is positioned to bear against the cap end of the delay-cartridge on assembly onto the conversion device to effect containment of said cartridge and primer in position within said chamber during firing.

7. A training device as in claim 3 wherein said firing assembly comprises a sliding firing pin with said hammer positioned to strike the firing pin under urging by said spring means when released to actuate said primer.

* * * * *